United States Patent [19]

Luker

[11] Patent Number: 4,969,343

[45] Date of Patent: Nov. 13, 1990

[54] SECURITY LOCKS

[76] Inventor: Graham J. Luker, 658 Port Hacking Road, Lilli Pilli, New South Wales, Australia, 2229

[21] Appl. No.: 415,376

[22] Filed: Sep. 27, 1989

Related U.S. Application Data

[63] Continuation of Ser. No. 206,540, Jun. 14, 1988, abandoned.

[30] Foreign Application Priority Data

Jun. 15, 1987 [AU] Australia ..... PI2466

[51] Int. Cl.[5] ..... E05B 65/10

[52] U.S. Cl. ..... 70/92; 70/465; 70/DIG. 49; 292/229

[58] Field of Search ..... 70/277–279, 70/432, 465, 92, DIG. 49; 292/229

[56] References Cited

U.S. PATENT DOCUMENTS

| | | | |
|---|---|---|---|
| 779,173 | 1/1905 | Merritt | 70/465 X |
| 975,175 | 11/1910 | St. Onge | 70/465 |
| 1,120,538 | 12/1914 | Richardson | 292/229 |
| 1,136,141 | 4/1915 | Kelley | 70/92 |
| 1,372,008 | 3/1921 | Darr | 70/92 |
| 2,238,414 | 4/1941 | Erickson | 292/229 |
| 2,259,766 | 10/1941 | Murphy | 292/229 X |
| 2,354,321 | 7/1944 | Kornkumpf | 70/465 |
| 2,356,276 | 8/1944 | Rossiter | 70/465 |
| 3,104,539 | 9/1963 | Cutler | 70/465 X |
| 3,325,203 | 6/1967 | Moler | 292/229 X |
| 3,810,145 | 5/1974 | Gusaras | 70/DIG. 49 X |
| 3,813,663 | 5/1974 | Perkins | 70/DIG. 49 X |
| 3,877,262 | 4/1975 | Williams | 70/92 |
| 3,890,608 | 6/1975 | Peterson | 70/DIG. 49 X |
| 4,226,101 | 10/1980 | Lee | 70/465 X |
| 4,271,691 | 6/1981 | Logan | 70/DIG. 49 X |
| 4,439,758 | 3/1984 | Cantley | 70/DIG. 49 X |
| 4,519,641 | 5/1985 | Fujiya | 70/92 X |
| 4,546,345 | 10/1985 | Naito | 70/DIG. 49 X |
| 4,709,950 | 12/1987 | Zortman | 70/92 X |

FOREIGN PATENT DOCUMENTS

| | | | |
|---|---|---|---|
| 2918837 | 12/1980 | Fed. Rep. of Germany | 70/92 |
| 3512645 | 10/1986 | Fed. Rep. of Germany | 70/92 |
| 2546219 | 11/1984 | France | 70/92 |
| 2084643 | 4/1982 | United Kingdom | 70/92 |

*Primary Examiner*—Robert L. Wolfe
*Assistant Examiner*—Suzanne L. Dino
*Attorney, Agent, or Firm*—Townsend and Townsend

[57] ABSTRACT

A lock mechanism for an emergency exit door or the like is constructed with a tongue pivotable between two positions—an extended position and a retracted position, the former for use when the door is closed and locked, and the latter when the door is open—and a pawl arranged for releasably retaining the tongue in either or both of the two positions, the tongue being releasable from the pawl by depressing a breakable seal or by a cylinder key. The mechanism has the advantage of being readily releasable from the inside yet capable of being sealed against unauthorized use.

4 Claims, 3 Drawing Sheets

SECURITY LOCKS

This is a continuation of application Ser. No. 07/206,540, filed June 14, 1988, now abandoned.

BACKGROUND OF THE INVENTION

This invention relates to security apparatus and more particularly to locks for emergency exit doors or the like.

Emergency exit doors naturally have to be readily opened from the inside and in large office buildings this has given rise to difficulties with staff control. In particular problems have arisen with employees leaving through such exits without authorization during working hours to attend to personal business.

SUMMARY OF THE INVENTION

It is therefore an object of this invention to provide an improved lock mechanism for emergency exit doors or the like which while being readily releasable from the inside can nevertheless be sealed against unauthorized use. Other objects and advantages of the invention will become apparent in the following description.

Broadly this invention discloses a lock mechanism for a door comprising a tongue which in use is pivotable between an extended position in which said door is closed and locked, and a retracted position in which said door is open, and a pawl means for releasably retaining the tongue in said extended and/or retracted position: wherein said tongue is releasable by depressing a breakable seal or via a cylinder key.

BRIEF DESCRIPTION OF THE DRAWINGS

One preferred embodiment of this invention will now be described with reference to the attached representations in which.

DETAILED DESCRIPTION OF THE INVENTION AND PREFERRED EMBODIMENTS

Figure 1:
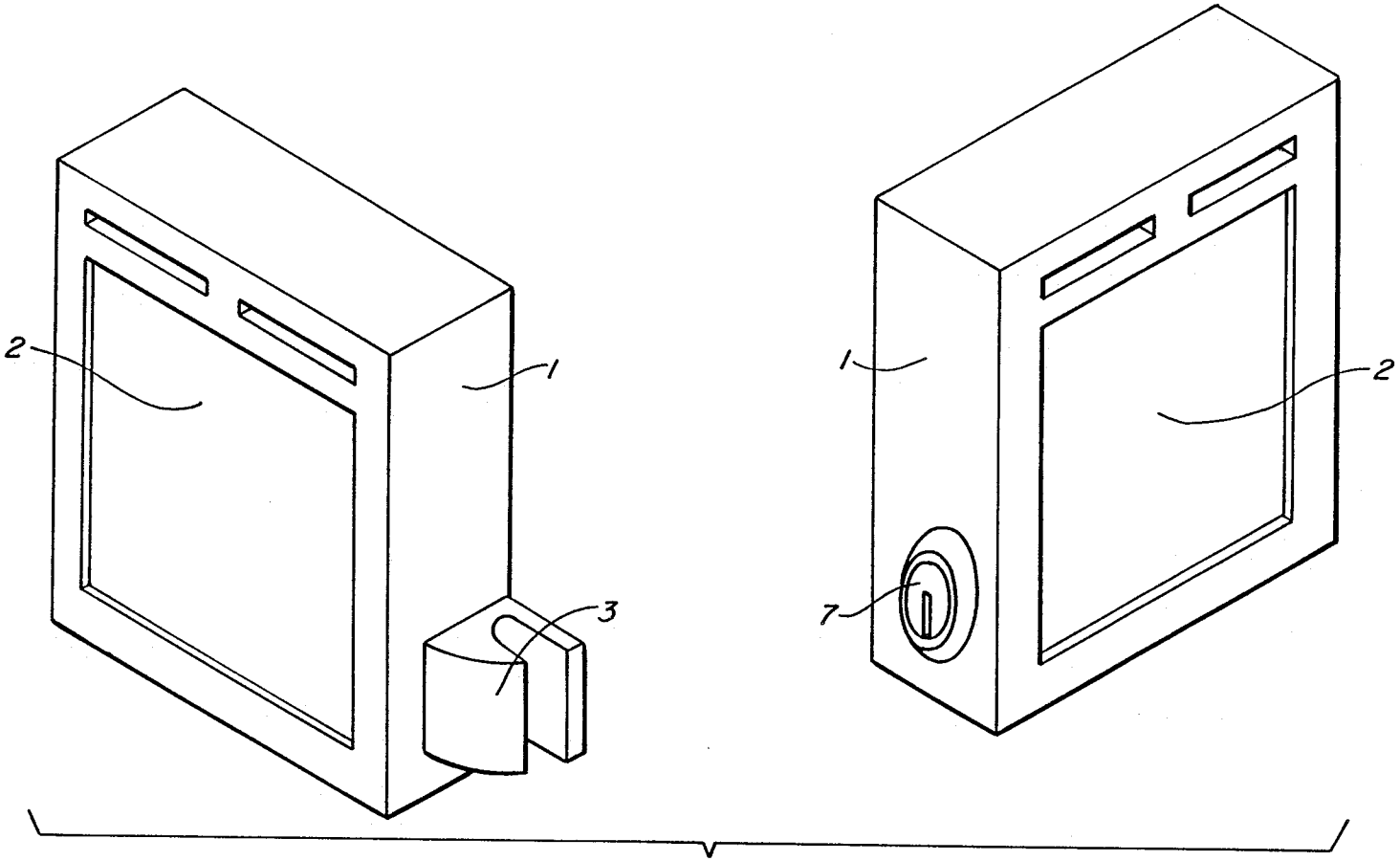
FIG. 1 shows perspective views of an assembled lock according to this invention.
Figure 2:
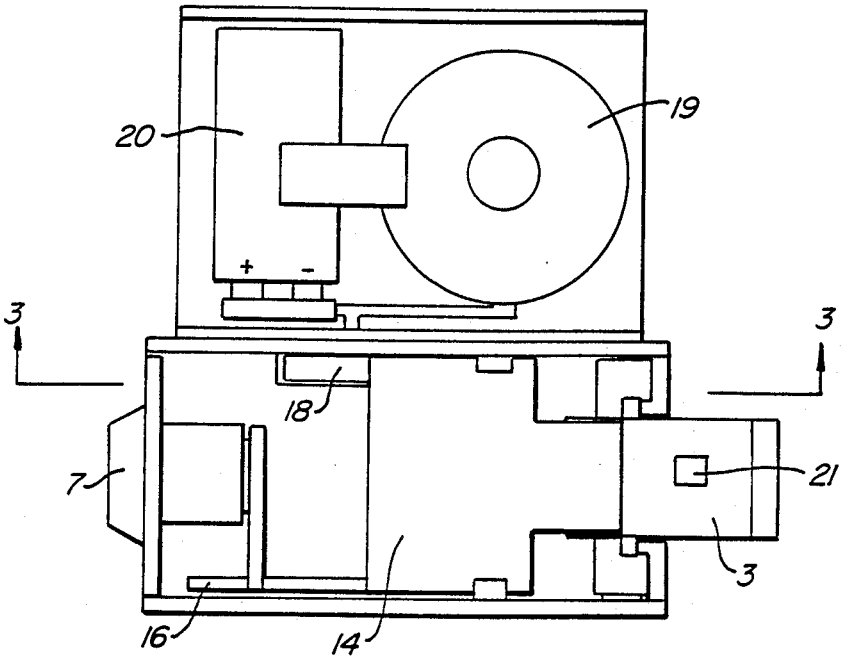
FIG. 2 shows the lock of FIG. 1 with the cover removed.

Referring first to FIG. 1 the lock may comprise a removable cover 1 with a frangible front panel 2 and a pivotable tongue 3 extending through one side. The lock is mounted in the usual fashion against the inside of an outswinging door so that the tongue aligns with an adjacent strike plate 4 and a recess 5 in the tongue engages a rib 6 formed on this plate. Holes (not shown) may be provided in the rear face of the housing for mounting screws to hold it flush against the door with the breakable panel 2 facing outwardly. Key operated cylinders 7 and 8 are also fitted into the opposite side and rear faces of the housing to enable the lock mechanism to be activated from either the inside or the outside through a corresponding aperture in the door as described later.

Figure 3:
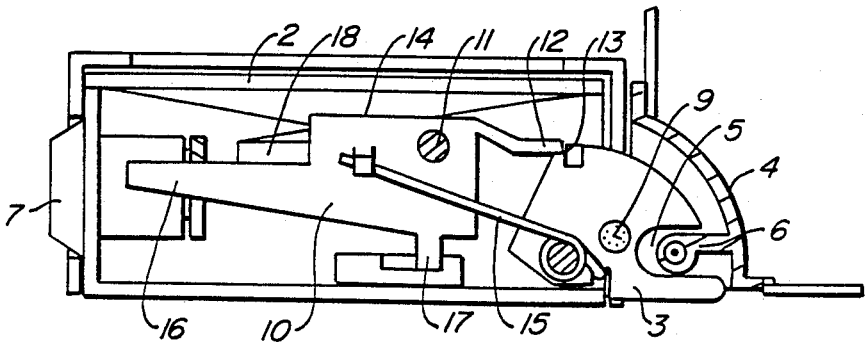
FIG. 3 shows a cross-sectional view of this lock along the lines A—A of FIG. 2 with the tongue in its extended position.
Figure 4:
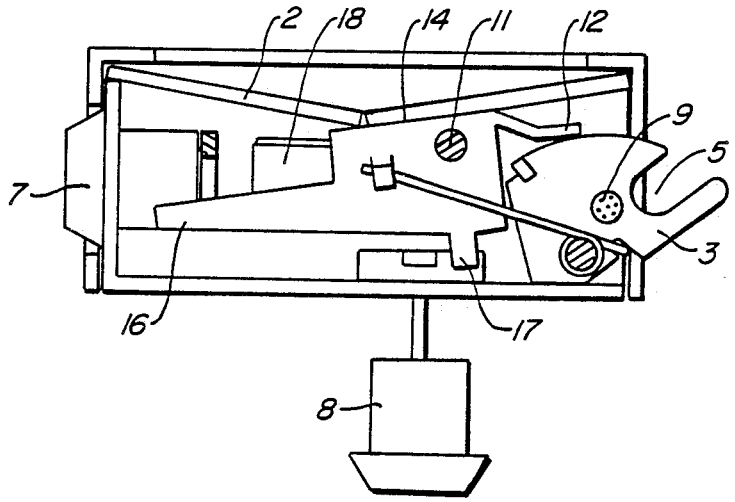
FIG. 4 shows a cross-sectional view of the lock along the lines A—A of FIG. 2 with the tongue in its retracted position.

As best shown in FIGS. 3 and 4 the tongue is mounted on a spindle 9 and is pivotable between an extended position in which it engages a rib 6 on an adjacent strike plate as mentioned earlier and a retracted position in which it clears this rib and allows the door to be opened. With this particular embodiment the tongue is releasably held in the extended or locked position by means of a pawl 10 mounted on a second spindle 11. One end 12 of this pawl is formed into a lug or prong which engages a niche 13 in the rear of the tongue 3. Depression of face 14 on this pawl however which is located directly behind breakable panel 2 pivots the prong 12 out of niche 13 and allows the tongue to rotate under the action of spring 15 to the retracted or open position. Alternatively the tongue can be released by rotating either of the key operated cylinders which displace respective fingers 16 and 17 to pivot the pawl.

With this device installed on the inside of an emergency exit door it will be appreciated that while the barrier is effectively locked to unauthorized personnel on either side immediate evacuation is easily obtained simply by pressing in the breakable panel 2. This panel preferably has a film over the outer surface to prevent splintering and is scored on the inside to fracture along a predetermined line under only moderate pressure. The face 14 immediately behind is then simultaneously depressed to release the tongue which then retracts to clear the strike plate as the door is pushed open. The tongue remains biased to this retracted position by spring 15 so that when the door is subsequently closed the recess 5 is aligned to re-engage rib 6 as the tongue pivots back into its extended position within the strike plate. Preferably this same spring 15 is also adapted to bias the pawl 10 to the locked position where it engages niche 13 in the tongue.

In addition to the aforementioned emergency procedure the two key operated cylinders 7 and 8 also allow authorized personnel to release the lock from either side of the door without breaking panel 2. Indeed, maintenance of the lock including replacement of the breakable panel can conveniently be done with the door open as the tongue is held in its retracted position. When the door is subsequently closed the tongue is automatically rotated back to its extended position and locked by pawl 10 as mentioned earlier.

As an additional security measure it is proposed that a micro switch 18 be incorporated into the lock mechanism. This switch would be closed by displacement of the pawl to its disengaged position and would activate either an internal alarm 19 powered by a battery 20 or alternatively a remote alarm located in another part of the building.

Further, a magnet and reed switch 21 may be incorporated into the tongue and strike plate which upon opening of the door also activates an alarm.

It will thus be appreciated that this invention at least in the form of the embodiment described provides a novel and unique security lock with a range of features and unobtrusive size not presently available. Clearly however the example disclosed is only one form of this invention and a wide variety of modifications may be made which would be apparent to one skilled in the art. For example the shape and configuration of the housing, tongue and pawl mechanism as well as the placement of the key operated cylinders may all be changed according to application or design preference.

What is claimed is:

1. A lock mechanism for a door, said lock mechanism comprising:

a tongue pivotally mounted to said door for pivoting between an extended position and a retracted position;

a strike plate with a rib extending therefrom;

a slot in said tongue to receive said rib;

a pawl pivotally mounted to said door to releasably engage a notch in said tongue thereby holding said tongue in said extended position;

single spring means joining said tongue and said pawl, said spring means biasing said tongue into said retracted position and said pawl into engagement with said notch;

a frangible panel constructed and arranged to permit breakage thereof upon the application of pressure thereto and upon such breakage to depress said pawl to pivot out the engagement with said notch; and key operated means arranged to release said pawl from either or both sides of said door.

2. A lock mechanism in accordance with claim 1 wherein said frangible panel is comprised of glass.

3. A lock mechanism in accordance with claim 1 further comprising a magnet and reed switch incorporated into said tongue and strike plate to activate an alarm when said door is opened.

4. A lock mechanism in accordance with claim 3 wherein said alarm is incorporated into said lock mechanism.

* * * * *